US009102046B2

(12) United States Patent
Mattson et al.

(10) Patent No.: US 9,102,046 B2
(45) Date of Patent: Aug. 11, 2015

(54) HAND TOOL IMPACTING DEVICE WITH FLOATING PIN MECHANISM

(75) Inventors: Christopher Mattson, Provo, UT (US); Jake Allred, Provo, UT (US); Jeremy Alsup, Provo, UT (US); Travis Anderson, Provo, UT (US); David Christensen, Provo, UT (US); Jacob Morrise, Provo, UT (US); Jon Ward, Lake Jackson, TX (US)

(73) Assignee: Brigham Young University, Provo, UT (US)

( * ) Notice: Subject to any disclaimer, the term of this patent is extended or adjusted under 35 U.S.C. 154(b) by 786 days.

(21) Appl. No.: 13/329,249

(22) Filed: Dec. 17, 2011

(65) Prior Publication Data

US 2012/0152577 A1 Jun. 21, 2012

Related U.S. Application Data

(60) Provisional application No. 61/459,872, filed on Dec. 20, 2010.

(51) Int. Cl.

| | |
|---|---|
| ***B25D 11/06*** | (2006.01) |
| ***B25D 17/08*** | (2006.01) |
| ***B25D 17/02*** | (2006.01) |
| ***B25D 17/00*** | (2006.01) |
| ***B25D 11/10*** | (2006.01) |
| ***B25D 16/00*** | (2006.01) |

(52) U.S. Cl.

CPC ..... *B25D 17/088* (2013.01); *B25D 11/102* (2013.01); *B25D 16/00* (2013.01); *B25D 17/005* (2013.01); *B25D 17/02* (2013.01); *B25D 2217/0034* (2013.01); *B25D 2250/371* (2013.01)

(58) Field of Classification Search

CPC ..... B25D 2216/0023; B25D 2216/0015; B25D 2216/0038; B25D 11/06; B25D 11/08; B25D 11/10; B25D 17/088; B25D 17/02; B25D 17/005; B25D 11/102; B25D 16/00–16/006

USPC ..... 173/48, 90, 104, 109, 114, 201–203, 173/122, 205, 213–222, 165–167, 171

See application file for complete search history.

(56) References Cited

U.S. PATENT DOCUMENTS

| | | | | | |
|---|---|---|---|---|---|
| 2,825,436 | A | * | 3/1958 | Amtsberg | 173/93.6 |
| 2,881,884 | A | * | 4/1959 | Amtsberg | 173/93.6 |
| 2,889,711 | A | * | 6/1959 | Morris | 74/22 R |
| 3,834,468 | A | * | 9/1974 | Hettich et al. | 173/48 |
| 3,931,744 | A | * | 1/1976 | Wunsch | 173/48 |
| 4,346,767 | A | | 8/1982 | Vaughan | |
| 4,378,053 | A | * | 3/1983 | Simpson | 173/13 |
| 4,489,792 | A | * | 12/1984 | Fahim et al. | 173/48 |
| 4,898,250 | A | | 2/1990 | Neumaier | |
| 5,199,505 | A | * | 4/1993 | Izumisawa | 173/93.6 |
| 5,653,294 | A | | 8/1997 | Thurler | |

(Continued)

*Primary Examiner* — Thanh Truong
*Assistant Examiner* — Joshua Kotis

(57) ABSTRACT

A hand tool impacting device may include a drive shaft, an impaler disk, and a floating pin positioned in an aperture of the drive shaft. Circular ramps along an outer edge of the impaler disk may interact with a stationary pin to translate the drive shaft and generate an impacting motion. A pair of springs placed against a side of the floating pin may allow a tool bit to engage or disengage the impaler disk, for selective use of translational impacting motion or rotational torque. An impact bit for engaging the impaler disk may include a tool head that may engage a work piece and a tool shaft inserted into the drive shaft to engage the floating pin.

20 Claims, 8 Drawing Sheets

(56) References Cited

U.S. PATENT DOCUMENTS

| | | | | |
|---|---|---|---|---|
| 5,794,325 | A * | 8/1998 | Fallandy | 29/566.4 |
| 6,192,996 | B1 | 2/2001 | Sakaguchi | |
| 6,913,090 | B2 | 7/2005 | Droste | |
| 7,131,503 | B2 | 11/2006 | Furuta | |
| 7,987,920 | B2 | 8/2011 | Schroeder | |
| 2006/0024141 | A1 * | 2/2006 | Schad | 408/8 |
| 2006/0278417 | A1 * | 12/2006 | Hahn | 173/178 |
| 2008/0035360 | A1 * | 2/2008 | Furuta | 173/104 |
| 2011/0100662 | A1 | 5/2011 | Wei | |

* cited by examiner

HAND TOOL IMPACTING DEVICE WITH FLOATING PIN MECHANISM

RELATED APPLICATIONS

This application claims priority to U.S. Provisional Patent Application No. 61/459,872 entitled "Hammer Drill in One" and filed on 20 Dec. 2010 for Christopher Mattson, Jake Allred, Jeremy Alsup, Travis Anderson, David Christensen, Jacob Morrise, and Jon Ward. The aforementioned application is incorporated herein by reference in its entirety.

BACKGROUND OF THE INVENTION

1. Field of the Invention

This invention relates generally to hand power tools and more particularly relates to an apparatus for creating an impacting motion in a powered hand tool.

2. Description of the Related Art

Hand drills are rotary tools that impose a rotational force onto a screw bit to drive a screw into a medium. Similarly, hand impact devices use a repeated translational impacting motion to drive a nail into a medium. Often times a project requires the use of both devices, which would require different tools. Delivering both a translational impact force and a rotational force in a single tool would therefore provide advantages that are lacking in currently available hand tools.

SUMMARY OF THE INVENTION

The present invention has been developed in response to the present state of the art, and in particular, in response to the problems and needs in the art that have not yet been fully solved by currently available impact devices. Accordingly, the present specification has been developed to provide an apparatus that allows a user the functionality of a rotary drill and an impact hammer in a single impacting device that overcomes many of the shortcomings in the art.

As described below, a hand tool impacting device may include, a rotating hollow drive shaft that has an aperture extending through a portion of its diameter, an impaler disk coupled to translate with the drive shaft, and a floating pin positioned within the aperture of the drive shaft that is configured to rotate the impaler disk along with the drive shaft. While engaged to the drive shaft, a set of circular ramps on the outer edge of the impaler disk may interact with a stationary pin insert to create a repeating impact motion. In one embodiment a pair of springs placed against either side of the floating pin may allow a specialized tool bit to engage or disengage the impaler disk, thereby allowing selective use of an impacting motion.

Additionally, as described below an impact bit for engaging the impaler disk may include, a tool head configured to engage a work piece and a tool shaft configured to be inserted into a tool chuck, and a tool shank that extends into a hollow drive shaft to engage a floating pin. According to one embodiment, the impact bit includes a plurality of sleeves to guide the tool head during operation.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
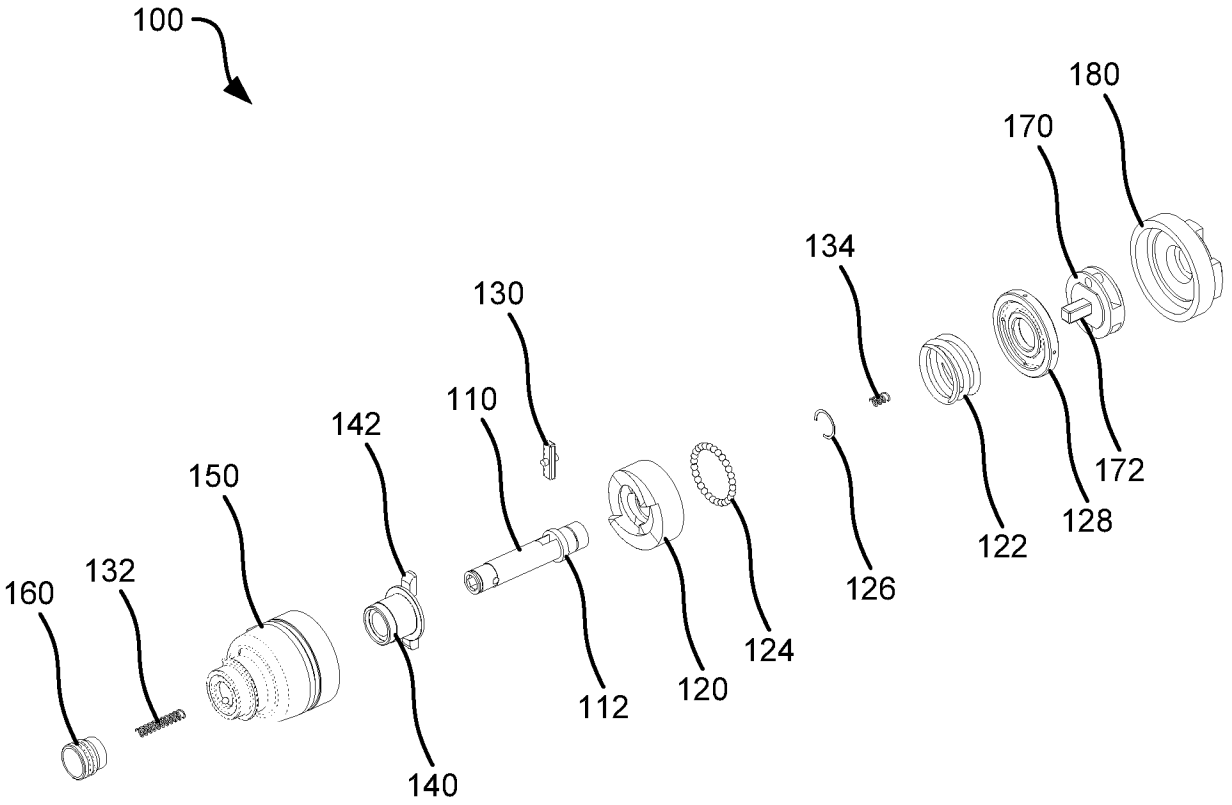
FIG. 1 is an exploded perspective view illustration of one embodiment of an impact device of the present specification suitable for a powered hand tool.

FIG. 1 is an exploded perspective view of one embodiment of an impacting device 100 of the present specification. As depicted, the impact device 100 may include a tool chuck 160, a housing 150, a pin insert 140 with raised pins 142, a hollow drive shaft 110, a floating pin 130 with a distal spring 132 and a proximal spring 134, an impaler disk 120, a coupling plate 170, and a backing plate 180.

In one embodiment, the impact device 100 may include a hollow drive shaft 110 which is configured to rotate. The hollow drive shaft 110 may include an aperture in which a floating pin 130 is positioned. The impact device 100 may also include an impaler disk 120 that is coaxial to the hollow drive shaft 110 and coupled to translate longitudinally with the drive shaft 110. According to one embodiment, a snap ring 126 and a circular protrusion 112 of the hollow drive shaft 110 ensure the impaler disk is coupled to translate with the drive shaft. The impaler disk 120 may be selectively coupled to the drive shaft 110 using the floating pin 130 such that when coupled, the impaler disk rotates with the drive shaft. Bearings 124 may be placed between the impaler disk 120 and the hollow drive shaft 110 to maintain the impaler disk stationary when not coupled to the drive shaft.

The impact device may also include a pin insert 140 with a plurality of raised pins 142. The pin insert 140 and raised pins 142 may remain stationary during the operation of the impact device 100. With the impaler disk 120 engaged, the plurality of raised pins 142 create a impacting motion.

One embodiment of the impacting device 100 includes a distal spring 132 and a proximal spring 134 that are configured to position the floating pin 130 within the aperture of the hollow drive shaft 110. In one example the springs 132, 134 align the floating pin 130 such that it does not engage the impaler disk 120. In another example the springs 132, 134 align the floating pin to engage the impaler disk 120. In this example the floating pin 130 is coupled to the impaler disk 120 which causes it to rotate with the drive shaft 110.

The impact device 100 may also include a coupling plate 170 that connects the hollow drive shaft 110 to an external power supply (not shown). In one embodiment an external power supply causes the coupling plate 170 to rotate. The coupling plate 170 may include a connecting shaft 172 that is configured to be inserted into the hollow drive shaft 110. This connecting shaft 172 transmits the rotational motion from the power supply to the drive shaft 110. The connecting shaft 172 also allows the hollow drive shaft 110 to translate along its length.

The impact device 100 may also include a backing plate 180 that is configured to attach the impact device 100 to a hand power tool. One embodiment of the impact device 100 includes a tool chuck 160 configured to receive a tool bit. Tool bits that may be used include, but are not limited to a screw driver, a drill bit, a chisel, a punch, and a flat surface for pounding a nail into a medium. The impact device 100 may also include a housing 150 that encloses the impact device.

Figure 2A:
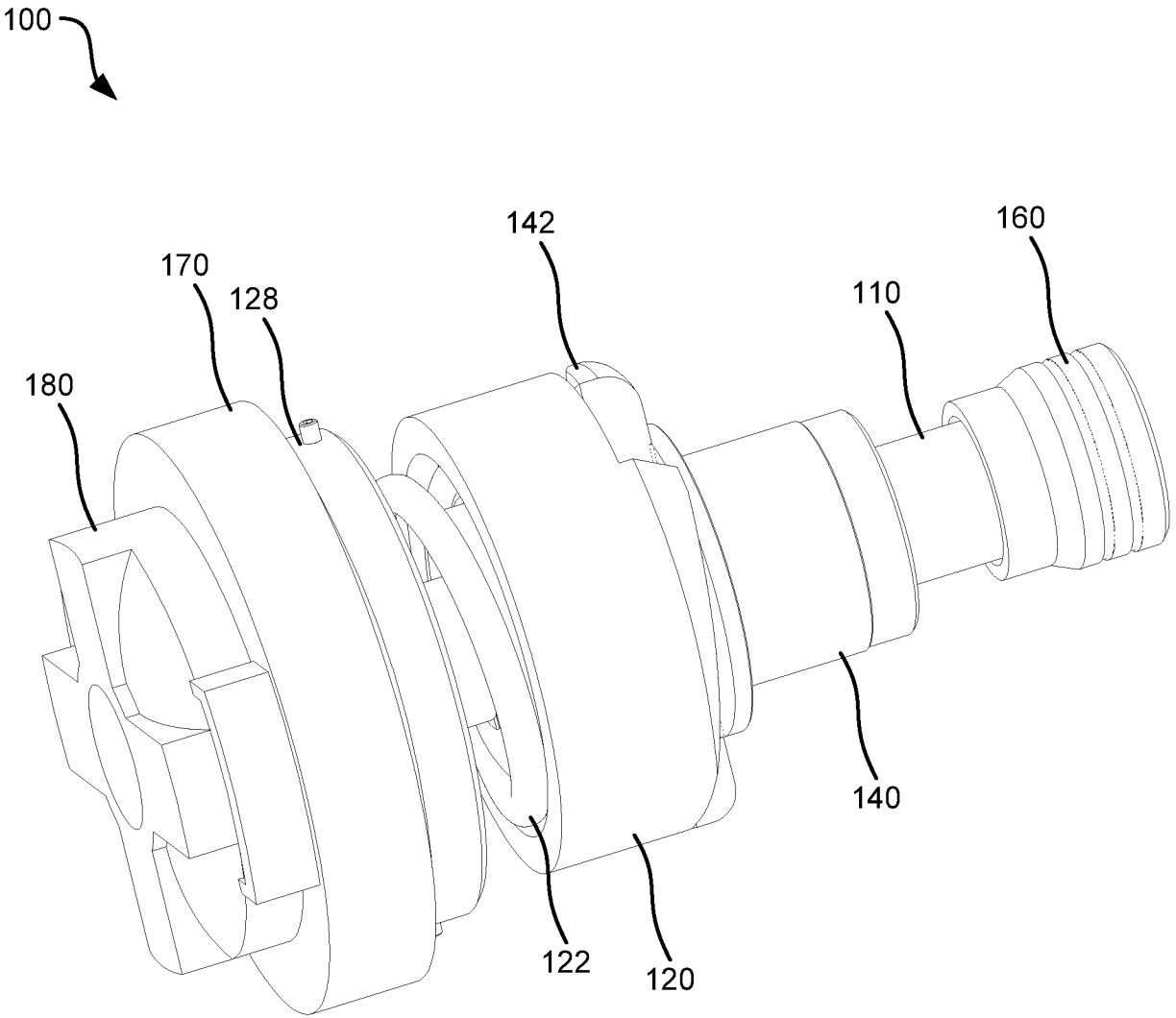
FIGS. 2*a* and 2*b* are perspective view illustrations of one embodiment of an assembled impact device of the present specification suitable for a powered hand tool.

FIG. 2*a* is a perspective view illustration of one embodiment of an assembled impact device 100. As depicted the assembled impact device 100 may include the tool chuck 160, the hollow drive shaft 110, pin insert 140 with raised pins 142, the impaler disk 120, the impaler spring 122, the impaler plate 128, the coupling plate 170, and the backing plate 180.

Figure 2B:
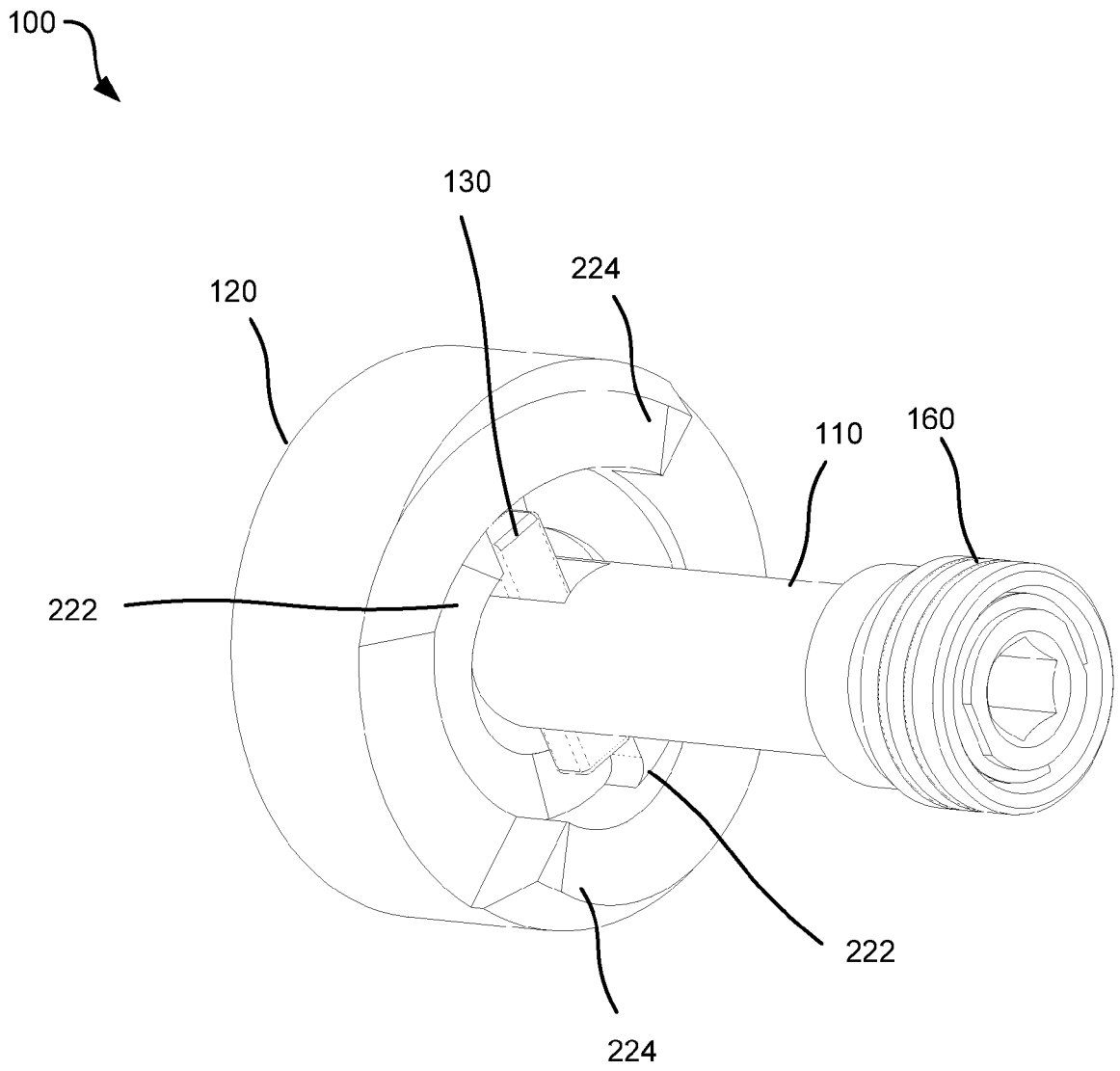

FIG. 2*b* is a perspective view illustration of one embodiment of an assembled impact device 100. As depicted the assembled impact device includes the tool chuck 160, the hollow drive shaft 110, the floating pin 130, and the impaler disk 120.

In one embodiment the impaler disk 120 may include a first plurality of circular ramps 222 which are positioned on the inner edge of a surface of the impaler disk 120. In this embodiment, a portion of the floating pin 130 may extend beyond the diameter of the hollow drive shaft 110. A shaft inserted into the hollow drive shaft 110 may position the extended portion of the floating pin 130 against the flat surface of the first plurality of circular ramps 222. In this fashion, as the hollow drive shaft 110 rotates in a counter clockwise direction, the floating pin 130 exerts a force against the flat surface of the first plurality of circular ramps 222 causing the impaler disk 120 to rotate with the drive shaft. In another mode of operation, as the drive shaft 110 rotates in a clockwise direction, the floating pin 130, slides along the incline of the first plurality of circular ramps 222. In this mode of operation the impaler disk 120 does not rotate with the drive shaft 110.

The impaler disk 120 may also include a second plurality of circular ramps 224 which are positioned on the outer edge of a surface of the impaler disk 120. With the impaler disk 120 rotationally coupled to the drive shaft 110, the second plurality of circular ramps 224 may interact with the stationary raised pins 142. The stationary raised pins 142 cause the impaler disk 120 and drive shaft 110 to translate backwards compressing the impaler spring 126 against the impaler plate 128. As the raised pins 142 slide off the flat surface of the second plurality of circular ramps 224, the impaler spring 126 forces the impaler disk 120 and drive shaft 110 forward, thus creating a translational impacting motion.

Figure 3A:
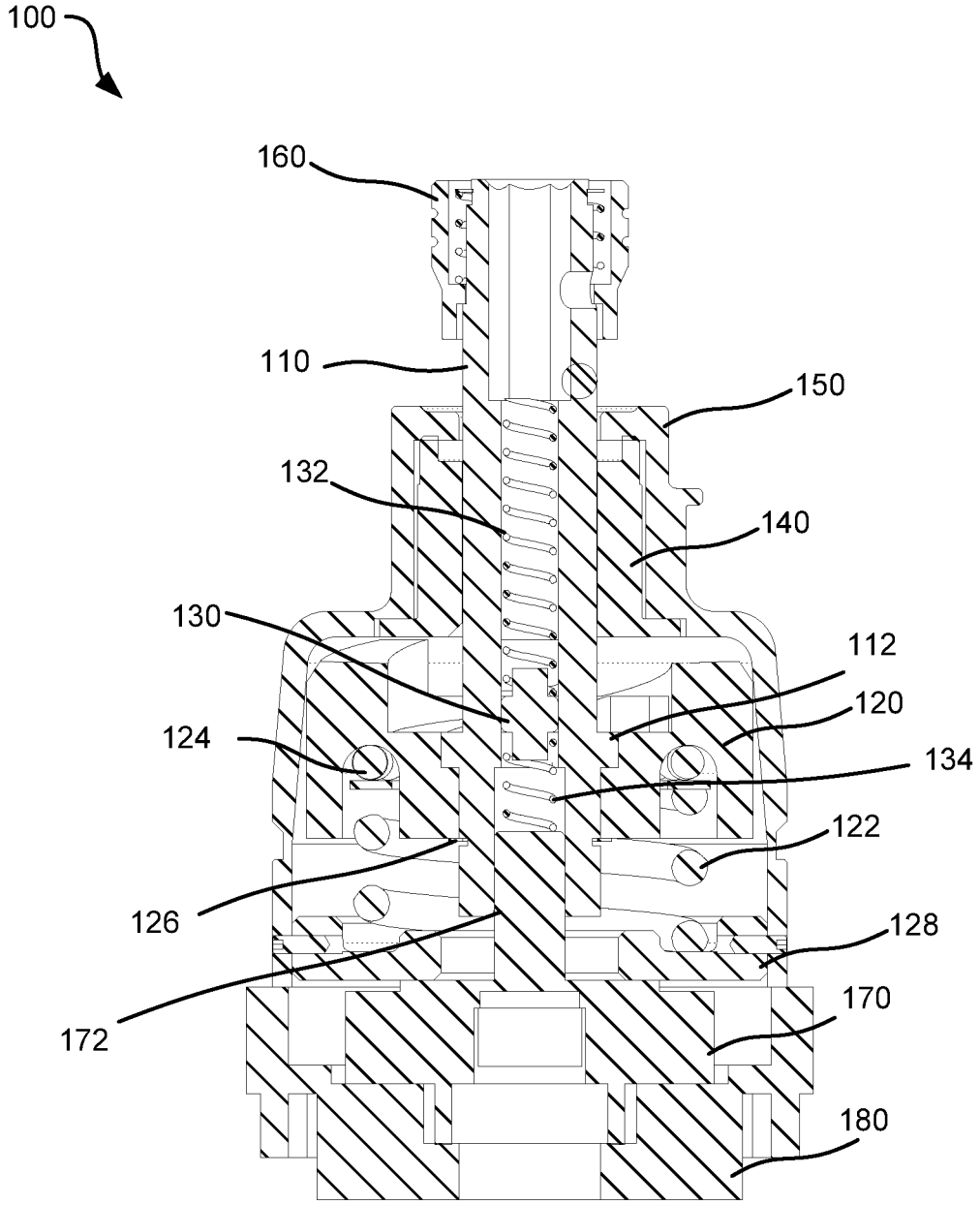
FIGS. 3*a* and 3*b* are detailed sectional side view illustrations of one embodiment of an impact device of the present specification suitable for a powered hand tool.
Figure 3B:
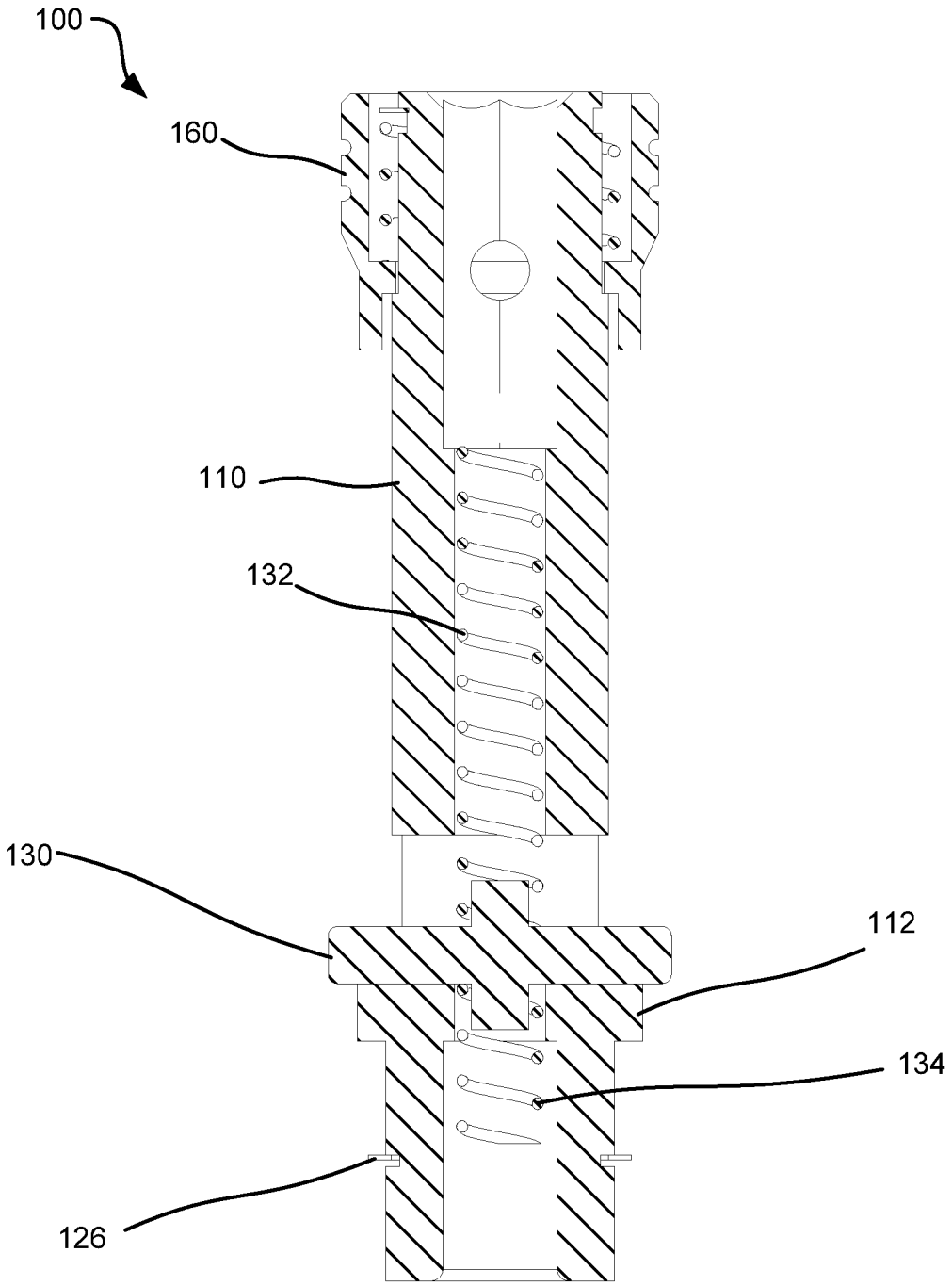

FIGS. 3*a* and 3*b* are detailed sectional side view illustrations of one embodiment of an impact device of the present specification 100. As depicted in FIG. 3*b*, in one example the distal spring 132 and the proximal spring 134 are positioned such that the floating pin 130 is not coupled to the impaler disk 120 and the impaler disk is not rotating with the drive shaft 110. In another example, a tool shank inserted into the hollow drive shaft 110 positions the floating pin 130 such that it is coupled to the impaler disk 120 which causes the impaler disk to rotate with the drive shaft 110.

Figure 4:
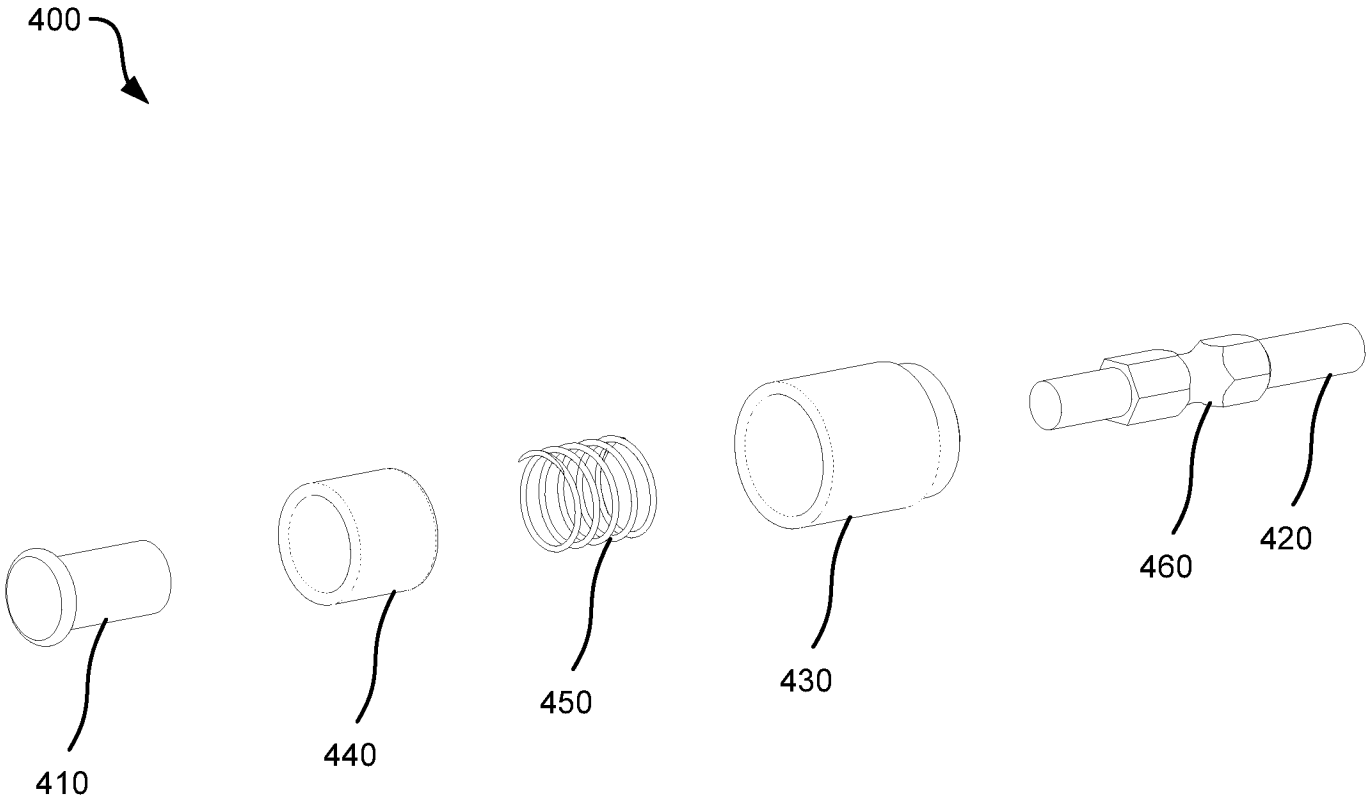
FIG. 4 is an exploded perspective view illustration of one embodiment of an impact bit of the present specification suitable for a powered hand tool.

FIG. 4 is an exploded perspective view illustration of one embodiment of an impact bit of the present specification 400. As depicted the impact bit may include a tool shaft 460, a tool shank 420, an outer sleeve 430, a sleeve spring 450, an inner sleeve 440, and a tool head 410.

In one embodiment, the impact bit 400 may be configured to be inserted into a tool chuck 160, as shown in FIGS. 1 through 3*b*. In this embodiment, the tool shank 420 may be configured to extend down the hollow drive shaft 110 and position the floating pin 130 against the impaler disk 120.

The impact bit 400 may also include a tool head 410 to interact with a fastener. In one example the tool head 410 is a flat surface that is configured to pound a nail into a medium. Other examples of tool heads 410 that may be used include but are not limited to, a screwdriver, a drill bit, and a chisel. The impact bit 400 may also include an outer sleeve 430 that extends beyond the tool head 410 to align the tool head with the fastener. The impact bit may also include a retractable inner sleeve 440 that extends beyond the outer sleeve 430. A sleeve spring 450 allows the inner spring 440 to retract into the outer spring 430. For example, the inner sleeve 440 may retract into the outer sleeve 430 as it is pressed against the medium into which the fastener is being driven.

Figure 5:
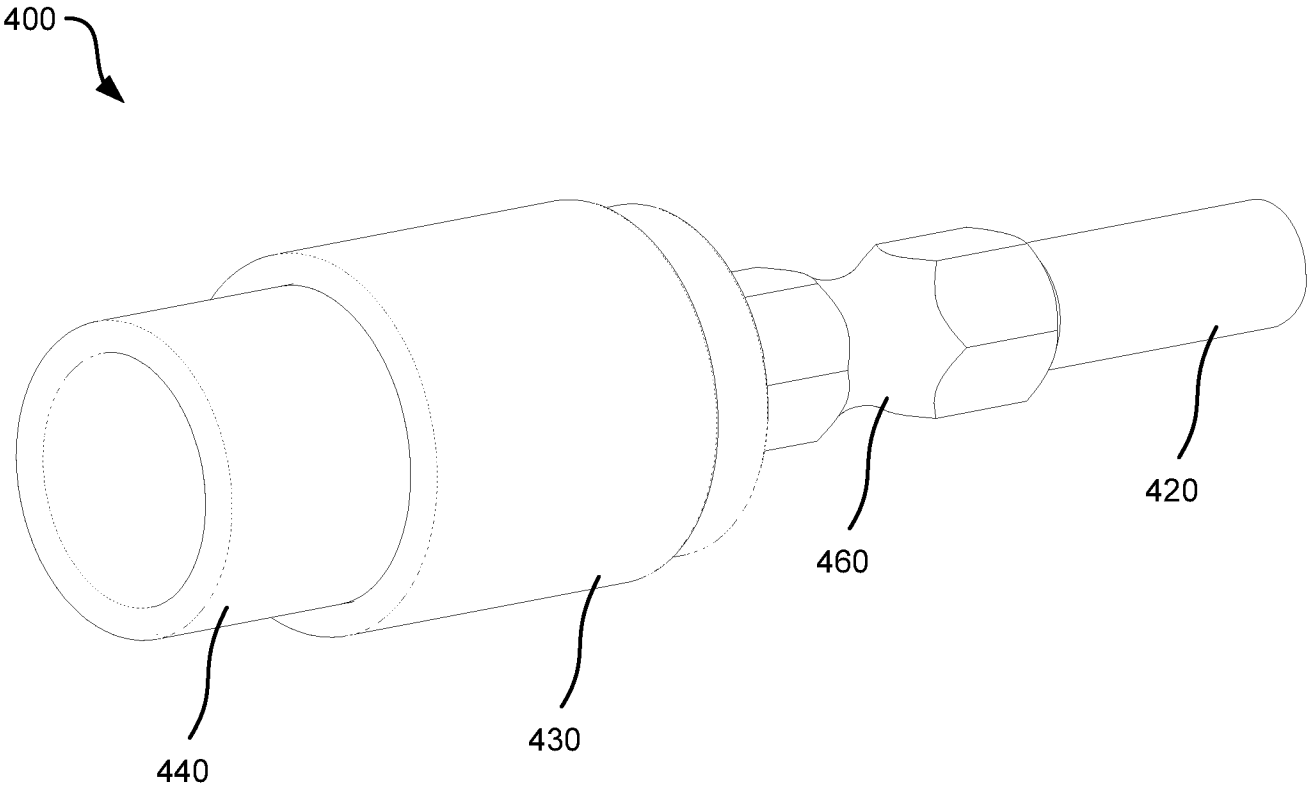
FIG. 5 is a perspective view illustration of one illustration of one embodiment of an assembled impact bit of the present specification suitable for a powered hand tool.

FIG. 5 is a perspective view illustration of one illustration of one embodiment of an assembled impact bit 400 of the present specification. As depicted the assembled impact bit 400 may include the tool shank 420, the tool shaft 460, the outer sleeve 430, and the inner sleeve 440.

Figure 6:
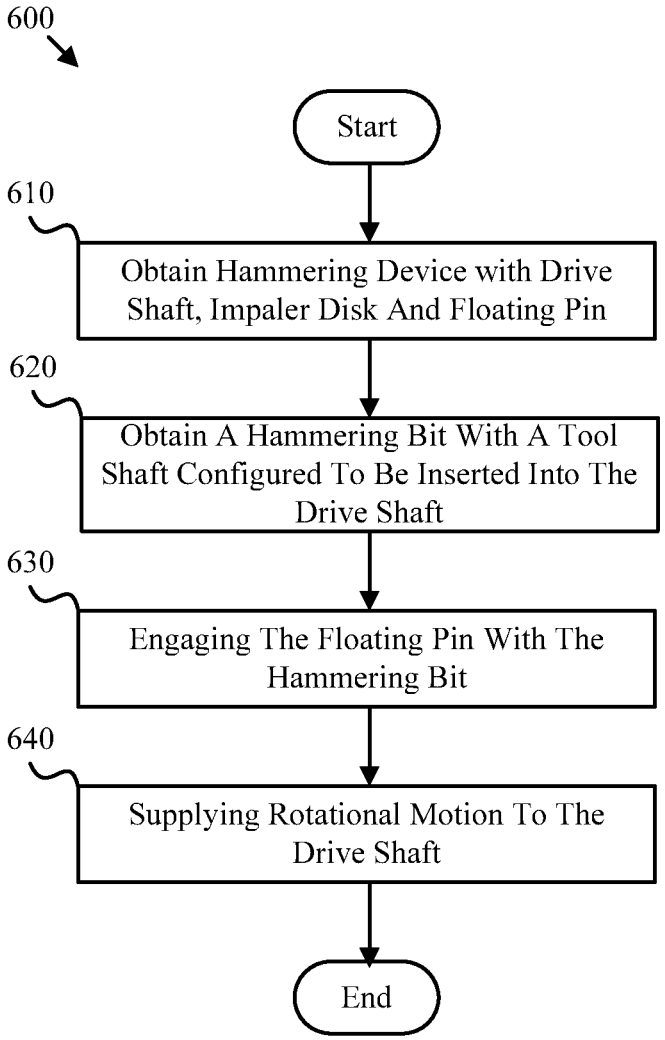
FIG. 6 is a flowchart diagram of one embodiment of an impacting method of the present invention.

FIG. 6 is a flowchart diagram of one embodiment of an impacting method 600 of the present invention. As depicted, the impacting method 600 includes obtaining 610 an impacting device, obtaining 620 an impact bit, engaging 630 the floating pin with the impact bit, and supplying 640 rotational motion to the drive shaft. The depicted method may be conducted in conjunction with the impacting device 100 and impact bit 400 or the like.

Obtaining 610 a impacting device may include obtaining a device comprising a hollow drive shaft with an aperture, an impaler disk coupled to translate longitudinally with the drive shaft, and a floating pin positioned within the aperture. The impaler disk may include a first plurality of circular ramps used to rotationally couple the impaler disk to the drive shaft. The impaler disk may also include a second plurality of circular ramps that create an impacting motion. In one embodiment, the obtained impacting device is the impacting device 100.

Obtaining 620 an impact bit may include obtaining a device comprising a tool head configured to engage a work piece, a tool shaft configured to be inserted into a tool chuck, and a tool shank configured to extend into a hollow drive shaft to engage an impacting device. In one embodiment, the obtained impact bit may be the impact bit 400.

The method may continue by engaging 630 the floating pin with the impact bit. This is done as the impact bit is inserted into the impacting device. In one embodiment the impact bit is configured to extend into the impacting device to engage the floating pin of the impacting device to create a translational impacting motion.

With the impact bit inserted into the impacting device, the method may continue by supplying 640 rotational motion to the drive shaft of the impacting device. In one example this rotational motion is supplied by an electric motor positioned within a powered hand tool.

The present invention provides an improved impacting device hand power tool and drive train. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hand tool impacting device, comprising:

a hollow drive shaft having an outer wall defining a hollow interior space;

an aperture defined in the outer wall of the drive shaft;

an impaler disk coaxial to coaxially aligned with the drive shaft;

a plurality of first ramps arranged along an inner peripheral edge of a distal surface of the impaler disk, each of the plurality of first ramps having an arcuate contour corresponding to a contour of an adjacent portion of the inner peripheral edge of the distal surface of the impaler disk and extending at an incline with respect to the distal surface of the impaler disk;

a plurality of second ramps arranged along an outer peripheral edge of the distal surface of the impaler disk, surrounding the plurality of first ramps;

a tool chuck coupled to a distal end of the drive shaft; and a floating pin positioned within the aperture and extending radially outward beyond an outer diameter of the drive shaft, the floating pin being configured to engage with the plurality of first ramps in response to insertion of a tool bit into the hollow interior space of a distal end of the drive shaft.

2. The impacting device of claim 1, further comprising:

an impaler spring coupled to a proximal surface of the impaler disk;

a pin insert coaxially aligned with the drive shaft; and a plurality of raised pins on a proximal surface of the pin insert, the plurality of raised pins being configured to engage with the plurality of second ramps.

3. The impacting device of claim 2, wherein each of the plurality of second ramps has a shape corresponding to an adjacent portion of the outer peripheral edge of the distal surface of the impaler disk, each of the plurality of second ramps including:

an inclined surface extending at an incline from a first end thereof at the distal surface of the impaler disk to a second end thereof spaced apart from the distal surface of the impaler disk; and a flat step surface extending from the second end of the inclined contact surface to the distal surface of the impaler disk.

4. The impacting device of claim 3, wherein, in response to clockwise rotation of the drive shaft, each of the plurality of pins of the pin insert is configured to move along the inclined surface of a respective second ramp of the plurality of second ramps and then down the flat step surface of the respective second ramp of the plurality of second ramps, and then along the inclined surface and flat stepped surface of subsequent adjacent second ramps to repeatedly generate a translational impact motion.

5. The impacting device of claim 1, further comprising:

a distal spring positioned within the hollow interior space of the drive shaft, abutting a distal surface of the floating pin; and a proximal spring positioned within the hollow interior space of the drive shaft, abutting a proximal surface of the floating pin such that the floating pin is positioned between the distal spring and the proximal spring.

6. The impacting device of claim 1, further comprising:

a housing that encompasses the drive shaft, impaler disk, and floating pin; and a backing plate attached to an open end of the housing and configured to attach the housing to a tool shell.

7. The impacting device of claim 1, further comprising:

bearings positioned between the impaler disk and the drive shaft;

a circular protrusion on an outer surface of the drive shaft, the circular protrusion abutting the distal surface of the impaler disk; and a fastening device connected to the drive shaft, the fastening device abutting the proximal surface of the impaler disk.

8. The impacting device of claim 1, wherein the drive shaft is configured to be coupled to a motor and a drive train so as to receive a rotational force generated by the motor.

9. The impacting device of claim 8, further comprising:

a coupling plate configured to couple a motor shaft of the motor to a proximal end of the drive shaft; and a connecting shaft protruding from a distal surface of the coupling plate and configured to be inserted into the hollow interior space at the proximal end of the drive shaft.

10. The impacting device of claim 1, wherein the plurality of first ramps are sequentially arranged along the inner peripheral edge of the distal surface of the impaler disk, and the plurality of second ramps are sequentially arranged along the outer peripheral edge of the distal surface of the impaler disk.

11. The impacting device of claim 1, wherein the aperture includes a first opening in the outer wall of the drive shaft and a second opening in the outer wall of the drive shaft, the second opening being located diametrically across from the first opening such that the floating pin extends through the hollow drive shaft, with a first end portion of the floating pin extending radially outward from the first opening and a second end portion of the floating pin extending radially outward from the second opening.

12. The impacting device of claim 1, wherein the aperture extends diametrically across the drive shaft such that a first end of the floating pin extends radially outward from a first end of the aperture and a second end of the floating pin extends radially outward from a second end of the aperture.

13. The impacting device of claim 12, wherein each of the plurality of first ramps includes:

an inclined surface extending at an incline from a first end thereof at the distal surface of the impaler disk to a second end thereof spaced apart from the distal surface of the impaler disk; and a flat step surface extending from the second end of the inclined surface to the distal surface of the impaler disk.

14. The impacting device of claim 13, wherein, in response to counterclockwise rotation of the drive shaft, the first end of the floating pin is positioned against the flat step surface of a first ramp of the plurality of first ramps, and the second end of the floating pin is positioned against the flat step surface of a second ramp of the plurality of first ramps such that the impaler disk rotates together with the drive shaft.

15. The impacting device of claim 13, wherein, in response to clockwise rotation of the drive shaft, the first end of the floating pin and the second end of the floating pin each move along the inclined surface of a respective first ramp of the plurality of first ramps, then down the flat step surface of the respective first ramp of the plurality of first ramps, and then along the inclined surface and flat stepped surface of subsequent adjacent first ramps such that the drive shaft rotates independent of the impaler disk.

16. The impacting device of 13, wherein each of the plurality of second ramps has a shape corresponding to an adjacent portion of the outer peripheral edge of the distal surface of the impaler disk.

17. A hand tool impacting device, comprising:

a hollow drive shaft including an outer wall defining a hollow interior space;

a floating pin extending radially through the drive shaft, with a first end of the floating pin and a second end of the floating pin each extending radially outward from the drive shaft;

an impaler disk coaxially coupled to a proximal end of the drive shaft;

a tool chuck coaxially coupled to a distal end of the drive shaft and configured to guide and secure a tool bit in the hollow interior space at the distal end of the drive shaft;

a plurality of first ramps arranged in a circular pattern along an inner peripheral portion of a distal surface of the impaler disk, each of the plurality of first ramps having a peripheral contour corresponding to a contour of an adjacent portion of the inner peripheral edge of the distal surface of the impaler disk and extending at an incline with respect to the distal surface of the impaler disk; and a plurality of second ramps arranged in a circular pattern along an outer peripheral portion of the distal surface of the impaler disk, surrounding the plurality of first ramps, wherein the first and second ends of the floating pin are configured to engage with the first plurality of circular ramps in response to insertion of a tool bit into the hollow interior space at the distal end of the drive shaft.

18. The impacting device of claim 17, wherein, in response to insertion of the tool bit into the hollow interior space at the distal end of the drive shaft, the floating pin is in an engaged position with the first and second ends of the floating pin positioned against the distal surface of the impaler disk so as to engage the plurality of first ramps, and wherein, in response to counterclockwise rotation of the drive shaft with the floating pin in the engaged position, the first end of the floating pin abuts a flat step surface of a first ramp of the plurality of first ramps, and the second end of the floating pin abuts the flat step surface of a second ramp of the plurality of second ramps such that the impaler disk rotates together with the drive shaft.

19. The impacting device of claim 18, wherein the plurality of first ramps are sequentially arranged such that, in response to clockwise rotation of the drive shaft with the floating pin in the engaged position, the first end of the floating pin and the second end of the floating pin each move along an inclined surface of a respective first ramp of a plurality of first ramps, then down the flat step surface of the respective first ramp of a plurality of first ramps, and then along the inclined surface and flat stepped surface of subsequent adjacent first ramps such that the drive shaft rotates independent of the impaler disk.

20. The impacting device of claim 17, wherein each of the plurality of second ramps has a shape corresponding to an adjacent portion of the outer peripheral edge of the distal surface of the impaler disk, the plurality of second ramps being sequentially arranged such that, in response to clockwise rotation of the drive shaft, each of the plurality of pins of the pin insert is configured to move along an inclined surface of a respective second ramp of the plurality of second ramps and then down a flat step surface of the respective second ramp of the plurality of second ramps, and then along the inclined surface and flat stepped surface of subsequent adjacent second ramps to repeatedly generate a translational impact motion at the tool bit.

* * * * *

UNITED STATES PATENT AND TRADEMARK OFFICE

CERTIFICATE OF CORRECTION

PATENT NO. : 9,102,046 B2
APPLICATION NO. : 13/329249
DATED : August 11, 2015
INVENTOR(S) : Christopher Mattson et al.

It is certified that error appears in the above-identified patent and that said Letters Patent is hereby corrected as shown below:

In the claims

In column 5, line 40, in claim 1, after “disk” delete “coaxial to”.

In column 7, line 30, in claim 16, after “device of” insert -- claim --.

Signed and Sealed this
Fifth Day of January, 2016

Michelle K. Lee

Michelle K. Lee
*Director of the United States Patent and Trademark Office*